US009555863B2

(12) United States Patent
Robinson

(10) Patent No.: US 9,555,863 B2
(45) Date of Patent: Jan. 31, 2017

(54) EASY MAINTENANCE FLYING BOARD

(71) Applicant: FlyDive, Inc., San Diego, CA (US)

(72) Inventor: Brandon Robinson, Fruitland Park, FL (US)

(73) Assignee: FLYDIVE, INC., San Diego, CA (US)

( * ) Notice: Subject to any disclaimer, the term of this patent is extended or adjusted under 35 U.S.C. 154(b) by 35 days.

(21) Appl. No.: 14/750,542

(22) Filed: Jun. 25, 2015

(65) Prior Publication Data

US 2015/0375833 A1 Dec. 31, 2015

Related U.S. Application Data

(60) Provisional application No. 62/018,268, filed on Jun. 27, 2014, provisional application No. 62/121,073, filed on Feb. 26, 2015.

(51) Int. Cl.

| | |
|---|---|
| ***B63B 35/73*** | (2006.01) |
| ***B64C 39/02*** | (2006.01) |
| ***B63H 11/00*** | (2006.01) |

(52) U.S. Cl.

CPC ..... *B63B 35/73* (2013.01); *B63H 11/00* (2013.01); *B64C 39/026* (2013.01); *B63H 2011/006* (2013.01); *B63H 2011/008* (2013.01)

(58) Field of Classification Search

CPC ... B64C 39/026; B63B 35/731; B63H 11/107; B63H 11/113

See application file for complete search history.

(56) References Cited

U.S. PATENT DOCUMENTS

| | | | | |
|---|---|---|---|---|
| 3,277,858 | A | 10/1966 | they | |
| 5,947,788 | A | 9/1999 | Derrah | |
| 6,923,745 | B2 * | 8/2005 | Stearns | A63B 22/203 482/52 |
| 7,258,301 | B2 | 8/2007 | Li | |

(Continued)

FOREIGN PATENT DOCUMENTS

| | | | |
|---|---|---|---|
| CA | WO9633091 | A1 | 10/1996 |
| EP | 2837560 | A1 | 2/2015 |

(Continued)

OTHER PUBLICATIONS https://www.youtube.com/watch?v=udm7iVxzVOs YouTube video of Sep. 27, 2012 showing Russian flying board with independently swiveling feet members and remote controlled operatable flying board (pdf with several views attached.

*Primary Examiner* — Joseph W Sanderson

(74) *Attorney, Agent, or Firm* — Patent Law Offices of Rick Martin, P.C.

(57) ABSTRACT

A water propelled flying board has a left and a right thrust nozzle. Each thrust nozzle has a knuckle joint attachment to a pressure water manifold. The thrust nozzles can be independently swiveled forward, backward, sideways or other directions relative to the rider. A left foot and a right foot platform are independently secured to the respective nozzle inlet to allow the rider to go toe up of toe down, they can rotate 360 degrees independently with each foot. This enables trick flying maneuvers including spinning like a top. The knuckle joint can be either a hose segment or a bearing. The left and right foot platforms or center blocks can be locked together and can have a spring return to neutral assembly.

9 Claims, 8 Drawing Sheets

(56) References Cited

U.S. PATENT DOCUMENTS

| | | | | |
|---|---|---|---|---|
| 7,621,850 | B2 * | 11/2009 | Piaget | A63B 22/0056 482/54 |
| 7,735,772 | B2 | 6/2010 | Li | |
| 7,900,867 | B2 | 3/2011 | Li | |
| 8,336,805 | B1 * | 12/2012 | Zapata | B64C 39/026 114/315 |
| 9,145,206 | B1 * | 9/2015 | Robinson | B64C 39/00 |
| 9,440,714 | B2 * | 9/2016 | Robinson | B64C 39/00 |
| 2006/0089065 | A1 * | 4/2006 | Nash | B63J 2/06 440/88 A |
| 2008/0142644 | A1 * | 6/2008 | O'Roark | B64C 39/026 244/4 A |
| 2012/0226394 | A1 | 9/2012 | Marcus | |
| 2014/0103165 | A1 | 4/2014 | Zapata | |
| 2014/0263849 | A1 * | 9/2014 | Li | B64C 39/026 244/23 A |
| 2015/0028161 | A1 * | 1/2015 | Parks | B63H 11/04 244/23 R |
| 2015/0158567 | A1 | 6/2015 | Zapata | |
| 2016/0144960 | A1 * | 5/2016 | Homer | B64C 39/026 244/23 R |

FOREIGN PATENT DOCUMENTS

| | | | |
|---|---|---|---|
| EP | 2842864 | A1 | 3/2015 |
| FR | WO/2013/041786 | A1 | 3/2013 |
| FR | WO/2013/041787 | A1 | 3/2013 |

* cited by examiner

EASY MAINTENANCE FLYING BOARD

CROSS-REFERENCES TO RELATED APPLICATIONS

This is a non-provisional patent application claiming priority from provisional patent application no. 62/121,073 filed Feb. 26, 2015 and 62/018,268 filed Jun. 27, 2014 both of which are incorporated herein by reference in their entirety.

FIELD OF INVENTION

The present invention relates to an improved simple design for a water propelled flying board, wherein the basic design is described in U.S. patent application Ser. No. 14/066,997 issued as U.S. Pat. No. 9,145,206 on Sep. 29, 2015) and provisional application nos. 62/018,268 and 62/121,073, all of which are incorporated herein by reference in their entirety.

BACKGROUND OF THE INVENTION

The above referenced patent applications describe a flying board wherein the left and the right lift nozzles can be independently rotated forward and backward relative to the central Y housing that receives the high pressure water (from a jet ski). No prior art features of a spring return of the left and right platform segments or a locking of these segments exists.

SUMMARY OF THE INVENTION

The present design uses a new and twistable rubber hose or a bushing assembly that is easily replaced after wear and tear. There is also disclosed a least expensive method of plastic manufacturing to provide a complete system. Some parts are roto molded (rotational molding). Metal screws and bolts thread into brass inserts for all couplings.

A newly available competitor's model uses an expensive pair of watertight bearings to allow the powered nozzles to rotate. The present invention replaces those bearings with bendable rubber hoses. This greatly reduces the product cost and reduces maintenance issues with bearing replacements as sand always exists in the water. Thus, any bearing in a system like this will eventually wear out.

The present invention does have one main inlet bearing. But the two foot platforms, one on each arm of the Y tube, now rotate using a new, useful hose segment.

The present invention provides a spring return of the left and right platform segments and a locking of these segments.

The main aspect of the present invention is to provide water propelled flying board that has an independently rotatable nozzle under the left and the right foot platform with a spring return to a neutral position.

Another aspect of the present invention is to manually lock or unlock the foot platforms.

Another aspect of the present invention is to provide a low cost rubber hose bearing which is easily replaced to take the majority of the wear and tear of the rotational friction of the foot platforms under power.

Another aspect of the present invention is to use some roto molded parts with metal connectors.

Another aspect of the present invention is to provide a custom built hose to enable both a twisting and a bending motion.

Other aspects of this invention will appear from the following description and appended claims, reference being made to the accompanying drawings forming a part of this specification wherein like reference characters designate corresponding parts in the several views.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF THE DRAWINGS

Figure 1:
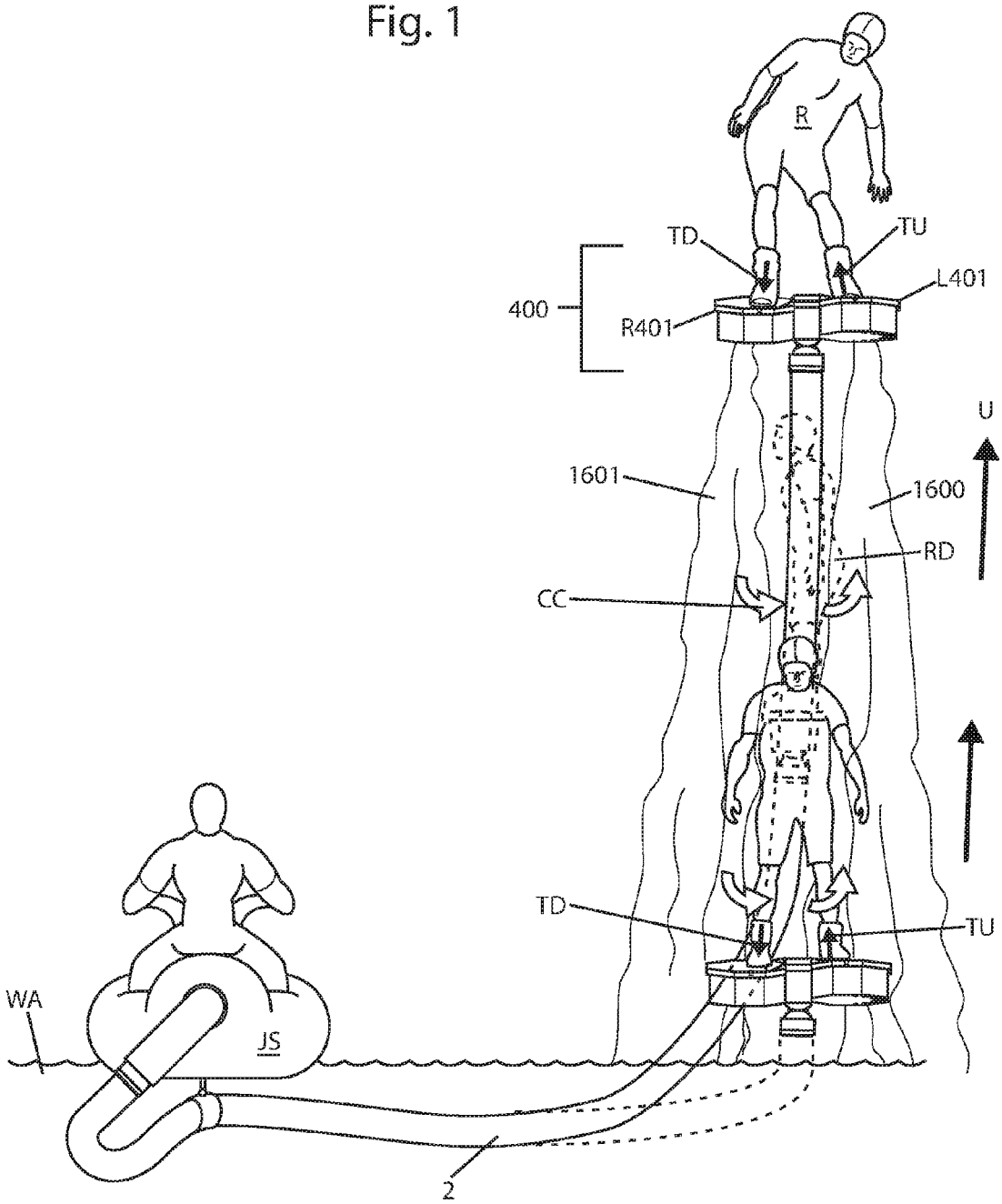
FIG. 1 is a front elevation view of a flyer maneuvering an easy maintenance swivel platform flying board.
Figure 2:
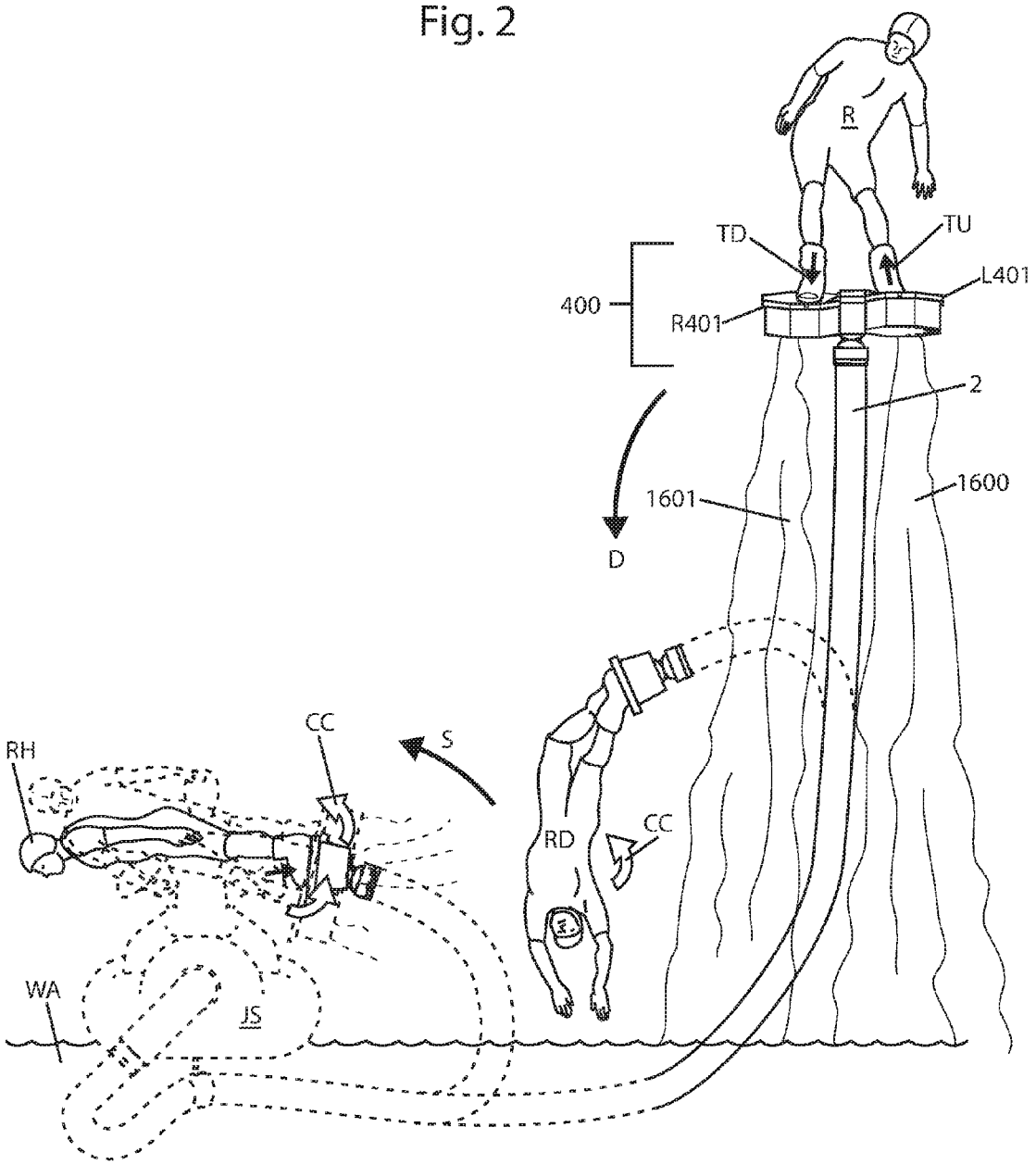
FIG. 2 is a front elevation view of a flyer shown doing tricks on the easy maintenance swivel platform flying board.

Referring first to FIGS. 1, 2 the jet ski JS floats on the water WA and powers the hose 2. In FIG. 1 the rider R has his left foot toe up TU and his right foot toe down TD. Thus, water thrust 1600 could force his left shoulder back while water thrust 1601 could force his right shoulder forward. The rider R spins in a counter clockwise CC pattern. The rider R depicted in dots RD shows him rotationally three fourths through his full 360° rotation while travelling up U.

In FIG. 2 the rider R starts high above the water WA. Then rider R dives down D while spinning counter clockwise CC as shown by rider RD. Then rider R surfaces S and proceeds horizontally as shown by rider RH. All this time he is rotating counter clockwise CC. He could reverse his rotation by changing his toe up/down positions.

Figure 3:
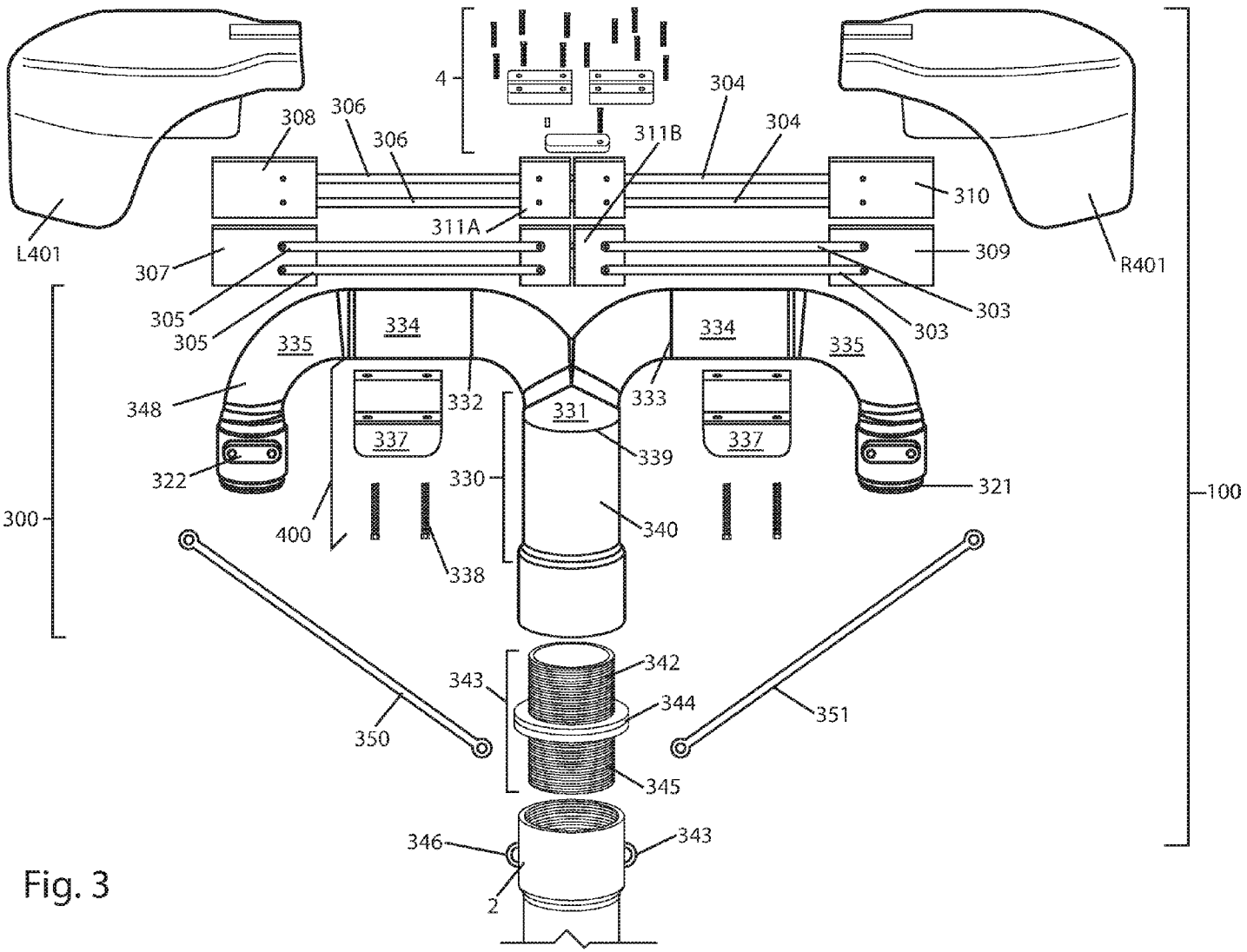
FIG. 3 is an exploded view of a hose bearing embodiment.

In FIG. 3 the Y pipe hose 348 can be made completely from silicone and fiber or other synthetic rubber.

Figure 6:
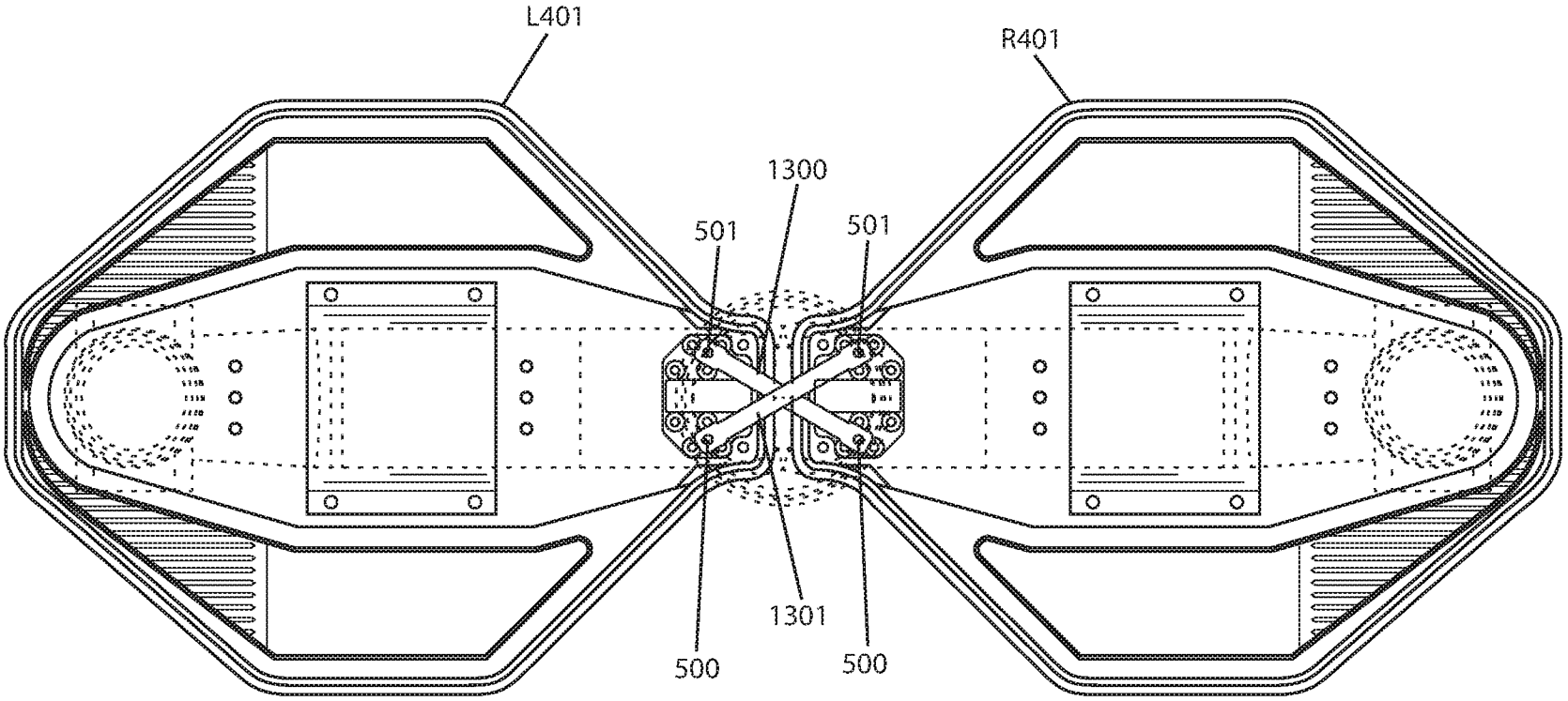
FIG. 6 is a bottom plan view of the hose embodiment showing the tension straps 2, 3.

FIG. 6 shows how crisscrossed elastic bands 1300 (attaches at 501, 500), 1301 (attaches at 500, 501) urge the left and right foot platforms L401, R401 to be parallel. Thus, the rider must push harder and harder as he increases the angular opposition between the left and the right platforms. This feature also protects the rider from injury. The elastic bands 1300, 1301, could be mounted parallel. The tension bands can be replaced by elastic metal springs.

Figure 4:
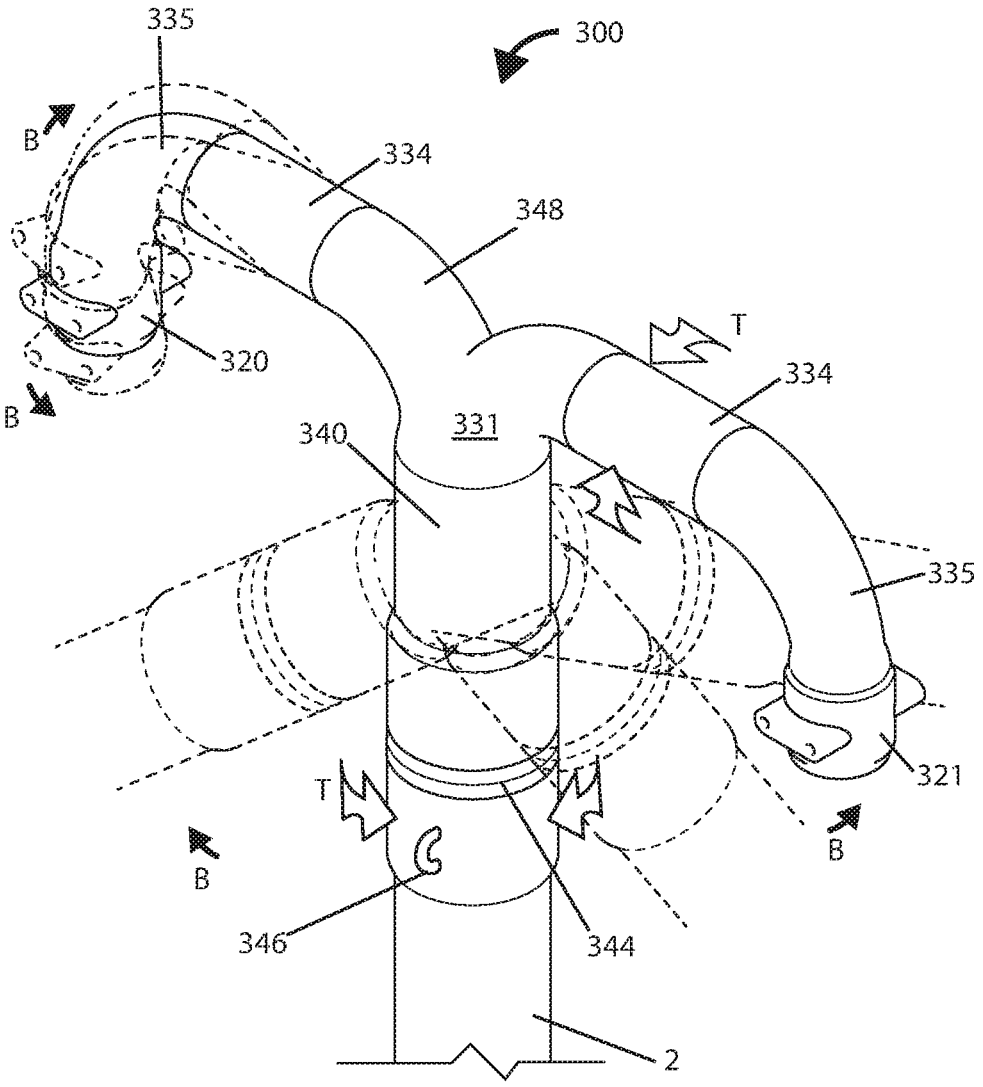
FIG. 4 is a front elevation view of the hose Y pipe assembly.

Referring next to FIGS. 3, 4 a flying board 100 has a left foot platform L401 which can bend and twist independently from a right foot platform R401. A lock assembly 4 can be attached to the platform or the center blocks, and it allows the rider to lock the left and right foot platforms together or the left and right center blocks 311A and 311B together. A stabilizing assembly 300 keeps the nozzles 320, 321 from flaring in or out or sideways, and it allows the nozzles to move 360 degrees. The center blocks 311A, 311B are supported by the Y pipe assembly 330 and are able to rotate.

The (metal) arms 303, 304, 305, 306 attach to the foot platforms via bolts (not shown) and anchors 307, 308, 309, 310 respectively. Design choice could add more or less arms. Brackets 322 attach to the respective foot platforms.

The Y pipe assembly 330 comprises a (plastic or metal) stiff central base built into the silicone hose 331. The left branch comprises a hose segment 334 connected to the port 332. The Y pipe hose 348 can be a one piece silicone hose or it can be made from other synthetic rubber. The hose can have metal or plastic parts built into it. The arrows B show how hose segment 334 can bend. The arms of the Y pipe hose are one piece 335,334, 333 and 332, and they can twist or bend. Hollow arrows T show how hose segment 334 can twist. Hose segment 335 bends downward to support the nozzle 320. Clamps 337 with bolts 338 form clasp 400 and secure the hose segment 334 to the respective foot platform.

Figure 5A:
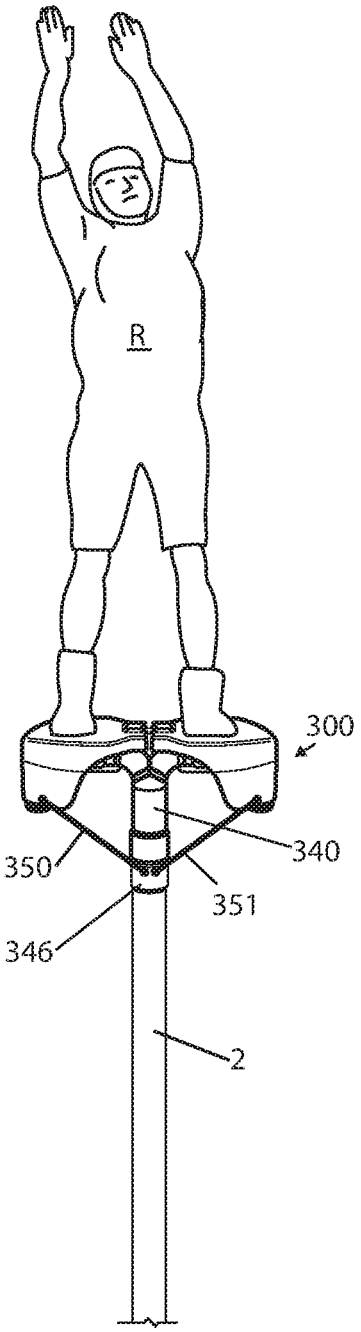
FIG. 5A is a front elevation view of the hose Y pipe embodiment going straight up.
Figure 5B:
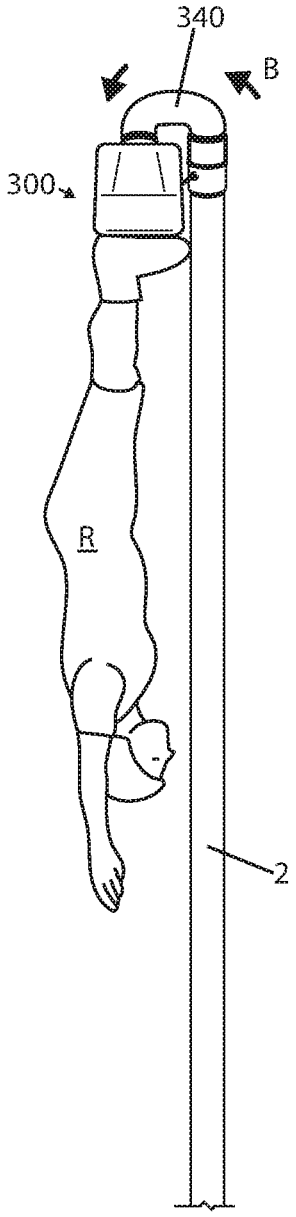
FIG. 5B is a front elevation view of the hose Y pipe embodiment going straight down.

A hose segment 340 attaches to the bottom port 339 of the central base 331. This hose segment 340 can bend 180 degrees as shown in FIGS. 4, 5B. It can be about six inches long or longer. This bending allows the rider R to do back flips or move forward or backward or sideways.

A threaded mender 343 connects the base of the Y pipe hose 340 to top 342, and the other end of the mender 345 connects to the fire hose 2. The mender section 344 can spin 360 degrees. A spinning type bearing (can be made with or without ball bearings) 344 allows lower threaded pipe 345 to spin relative to top 342. Support rods or cables 350, 351, can be stainless steel. They attach the respective boot platform to the collars 346, 343, thereby taking the (250 pound) weight of the hose 2 off the Y pipe assembly 330. FIG. 5A shows the rider R going straight up with hose segment 340 straight. FIG. 5A shows the rider R going straight down with hose segment 340 bent 180 degrees.

The hoses are made preferably of silicone rubber and polyester plain woven, used as a reinforcement ply. Other choices of synthetic rubber are equivalents.

Figure 7:
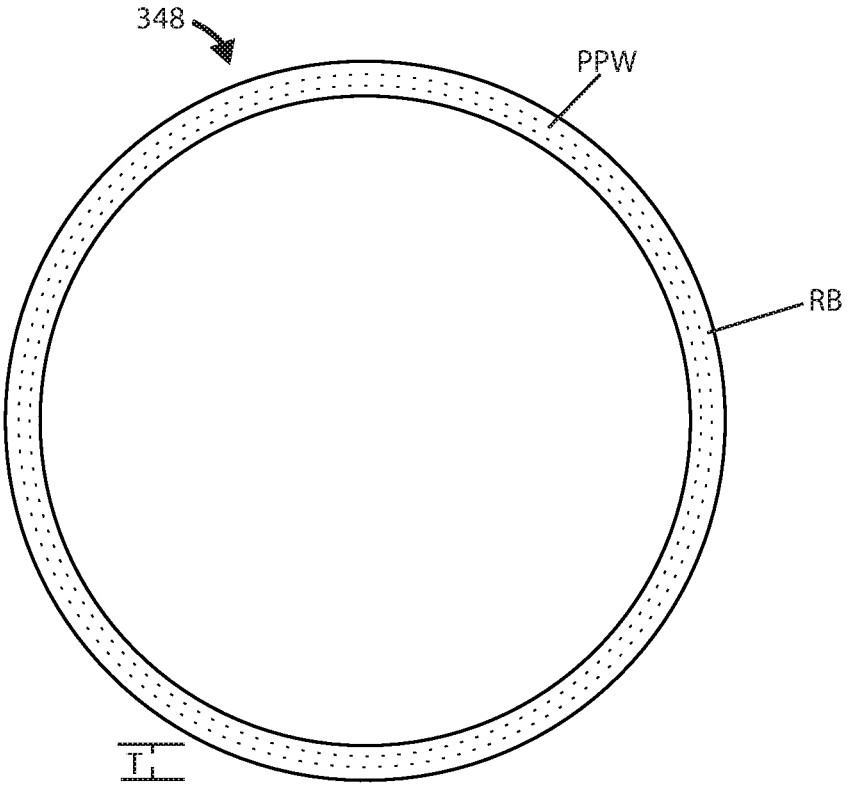
FIG. 7 is a cross sectional view of the hose.

FIG. 7 shows hose segment 348 with a silicone rubber body RB reinforced by polyester plain woven fibers PPW.

Nominal thickness T ranges from 0.10 inches to 0.50 inches.

Figure 8:
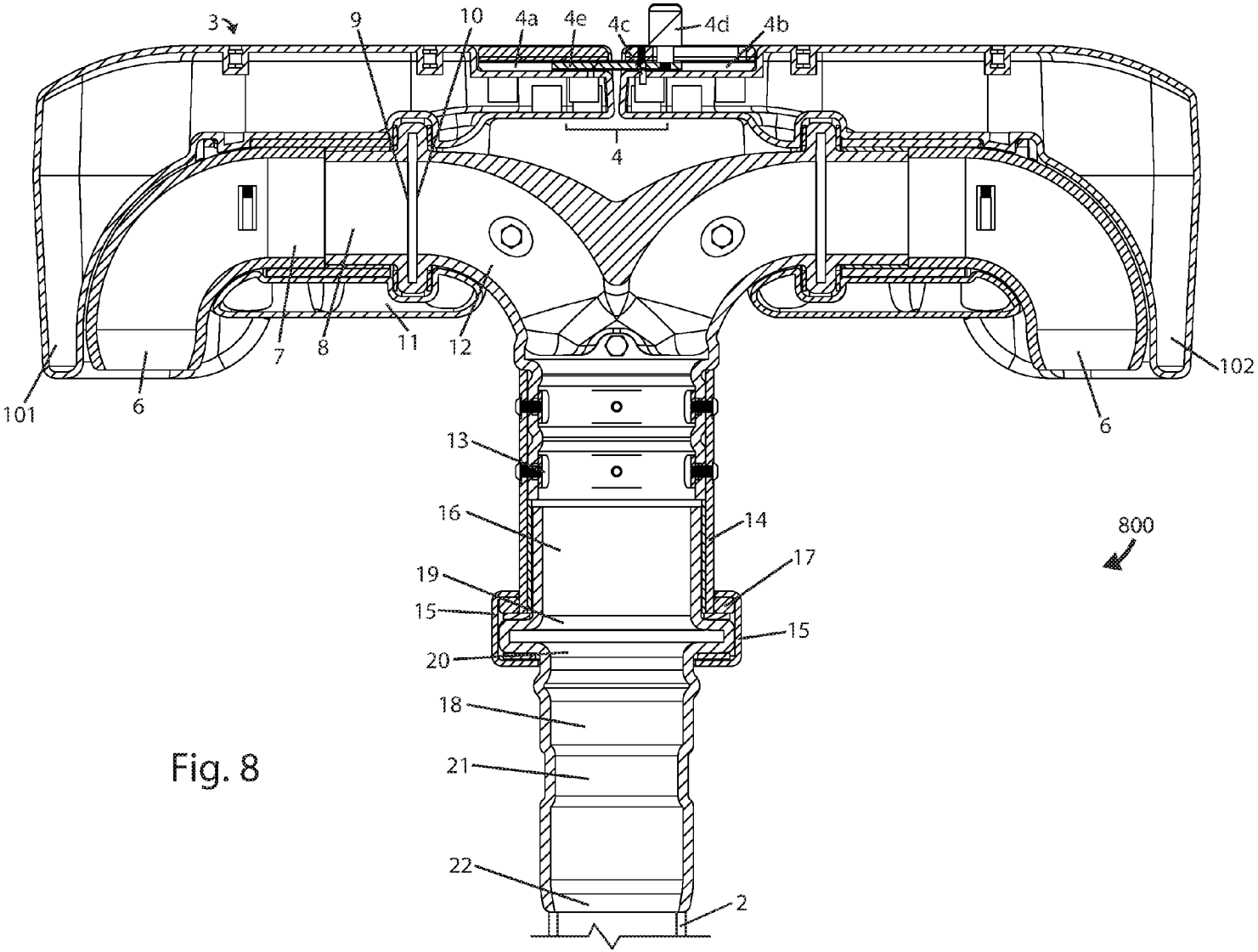
FIG. 8 is a longitudinal sectional view of one embodiment assembled which uses a plastic bearing.

Referring next to FIG. 8 a plastic bearing flying board is numbered 800. The parts are described below. The boards 400 and 800 perform the same.

The flying board 400 of FIG. 1 has a left foot platform L401 and a right foot platform R401.

| Part Number | Description |
|---|---|
| 101 | Right Platform (rider facing out) |
| 102 | Left Platform |

1. Platform—Binding (Boots) fasten on top of the platforms 101, 102 to enable a person to stand and have his feet fasten on top of each platform. Each platform can rotate with the nozzle 6 to provide more maneuverability, more tricks and more spins than when the platforms 101, 102 are locked together.

2. Platform Indented Surface—This is where the latch assembly 4 fastens on to the platform segments 101, 102 with inserted screw threads.

3. Platform Mount is arrow 3—Six inserted screw threads can be used to fasten bindings with screws to the platform segments 101, 102. There can be less or more screw threads removed or added.

4. Latch Assembly 4 comprises parts 4*a*, 4*b*, 4*c*, 4*d* and 4*e* described below. The latch assembly locks and unlocks the platforms 101, 102. This allows the person to have individual foot control or locks both platforms together. There can be one or more screws that fasten the latch assembly 4 on the platforms 101, 102.

4*a*. Latch Cover

4*b*. Latch Receiver

4*c*. Latch Adjustable Tension Screw

4*d*. Latch Handle

4*e*. Latch Plate

5. Threaded Inserts—4 threaded brass screw inserts underneath the platform to allow platform clamps to be fastened on to the platform. There can be less or more screws removed or added. There are threaded screw inserts in the platform for all screws and bolts, which are preferably brass or SS.

6. Nozzle—The nozzles 6 is where the water releases and provides lift for the flying board 800.

7. Tube Nozzle—The tube nozzle 7 holds the Y pipe 12 and the nozzle 6 together.

8. Upper Bearing is item 8—It fits between the tube nozzle 7 and Y-pipe 12. An inexpensive replaceable bearing that the Y-pipe 12 and tube nozzle 7 rotate on, so that it can prevent wear and adds life to both parts.

9. Upper Thrust Bearing is item 9, it fits between the Y-pipe 12 and tube nozzle 7. It is an inexpensive replaceable bearing that the Y-pipe 12 and tube nozzle 7 rotate against, so that it helps prevent wear and adds life to both parts.

10. Upper Thrust Bearing—This bearing is cut in half, the two halves fit between the Y-Pipe and Platform Clamp. It is an inexpensive replaceable bearing that the Y Pipe, Platform, and Platform Clamp rotate against, so that it helps prevent wear and adds life to all three parts.

11. Clamp Platform—Four bolts fastens each clamp platform 11 to hold the Y-pipe 12 and the nozzle 6 to the platform 101/102, this provides easily removal and allows the parts to be put back together easily. It also provides easy cleaning to remove sand and debris or replacing inexpensive bearings and thrust bearings in minutes.

12. Y-Pipe—The Y-pipe 12 splits or channels the water to the two nozzles 6. The Y-pipe can rotate 180 degrees.

13. Nut Plate Threaded and Screws 13 allow the tube bottom 14 to fasten to the bottom of the Y-pipe 12.

14. Tube Bottom 14 fastens onto the bottom of the Y-pipe. Provides the clamp 15 to hold together the Y-pipe and hole adapter 18.

15. Quick Release Clamp—A quick release clamp 15 holds or releases the tube bottom 14 and hose adapter 18. This enables a user to quickly put together to operate or take apart for ease of portability.

16. Lower Bearing 16 fits between the tube bottom 14 and hose adapter 18. An inexpensive replaceable bearing that is placed between the hose adapter 18 and tube bottom 14 to prevent wear and adds life to both parts. The hose adapter 8 rotates 360 degrees inside the clamp 15 and tube bottom 14.

17. Quick Release Pin 17—Two pins that quick releases or hold the clamp together.

18. Hose Adapter—The hose adapter 18 spins 360 degrees and is inserted into the tube bottom 14, plus it is held together by the quick release clamp 15. The hose 2 is fastened to the other end of the hose adapter 18. The end of the hose adapter 18 where the hose 2 fits on has an indentation to allow a clamp or clamps to hold the hose 2 onto the hose adapter 18.

19. Upper Thrust Bearing 19 fits between the tube bottom 14 and hose adapter 18. It is an inexpensive replaceable bearing that the hose adapter 18 rotates against, so that it helps prevent wear and adds life.

20. Lower Thrust Bearing 20 fits between the hose adapter 18 and the quick release clamp 15. it is an inexpensive replaceable bearing that the hose adapter 18 rotates against, so that it helps prevent wear and adds life.

21. Hose adapter recess is labeled 21.

22. Tip of hose adapter is labeled 22.

Rotational Molding (BrE molding also called roto molded) involves a heated hollow mold which is filled with a charge or shot weight of material. It is then slowly rotated (usually around two perpendicular axes) causing the softened material to disperse and stick to the walls of the mold. In order to maintain even thickness throughout the part, the mold continues to rotate at all times during the heating phase and to avoid sagging or deformation also during the cooling phase. The process was applied to plastics in the 1940s but in the early years was little used because it was a slow process restricted to a small number of plastics. Over the past two decades, improvements in process control and developments with plastic powders have resulted in a significant increase in usage.

Although the present invention has been described with reference to the disclosed embodiments, numerous modifications and variations can be made and still the result will come within the scope of the invention. No limitation with respect to the specific embodiments disclosed herein is intended or should be inferred. Each apparatus embodiment described herein has numerous equivalents.

I claim:

1. A flying water board comprising:

a central housing having a high pressure water inlet on a base pipe;

said central housing having a left and a right elbow stemming from the base pipe;

a swivel joint on each left and right elbow;

a thrust nozzle mounted to each swivel joint at distal end thereof;

a left foot platform having a mounting means functioning to secure the left foot platform to the left thrust nozzle where tilting the left foot platform swivels the left thrust nozzle;

a right foot platform having a mounting means functioning to secure the right foot platform to the right thrust nozzle where tilting the right foot platform swivels the right thrust nozzle independently from the left foot thrust nozzle;

said swivel joint comprising a bearing to twist while allowing high pressure water to flow therethrough; and a lock means functioning to lock the left foot platform to the right foot platform.

2. The flying water board of claim 1, wherein the base pipe further comprises a bearing above the high pressure water inlet, thereby enabling the base pipe to rotate.

3. The flying water board of claim 1, wherein the thrust nozzle further comprises a solid nozzle with a connection means functioning to removably connect to the foot platform.

4. The flying water board of claim 1 further comprising a spring means functioning to urge each of the left and right foot platforms to a neutral position, parallel to each other, above their respective swivel joints.

5. The flying water board of claim 4, wherein the spring means further comprises a crisscrossed or parallel pair of elastic bands attached to an underside of the left and right foot platforms.

6. The flying water board of claim 4, wherein the spring means further comprises a spring attached to an underside of the left and right foot platforms.

7. The flying platform of claim 1, wherein the lock means further comprises a left foot platform mounting means comprising a left center block and the right foot platform mounting means further comprises a right center block; and an inter block lock means functioning to lock the left center block to the right center block.

8. A flying water board comprising:

a water hose inlet connected to a base of a Y housing;

a rotating bearing on the base of the Y housing mounted on top of the water hose inlet;

said Y housing having a left and right arm extending from the base of the Y housing;

a bearing connected to a distal end of each arm of the Y housing which is in turn connected to a thrust nozzle;

a left foot platform connected to the left bearing along with the left foot platform's respective thrust nozzle;

a right foot platform connected to the right bearing along with the right foot platform's respective thrust nozzle;

a manual latch locking and unlocking the left to the right foot platform; and wherein a rider can point his left and his right toes up, down, or any direction and rotate the respective boot platform forward and backward and sideways and other directions.

9. The flying platform of claim 8 further comprising a spring means functioning to urge the left and the right foot platform to a neutral position on top of the platform's respective bearings.

* * * * *